US007639198B2

(12) United States Patent
Timofeev et al.

(10) Patent No.: US 7,639,198 B2
(45) Date of Patent: Dec. 29, 2009

(54) DIPOLE ANTENNA ARRAY HAVING DIPOLE ARMS TILTED AT AN ACUTE ANGLE

(75) Inventors: Igor E. Timofeev, Dallas, TX (US); Eddie Ray Bradley, Richardson, TX (US); Ky Q. Chau, Arlington, TX (US); Martin L. Zimmerman, Chicago, IL (US)

(73) Assignee: Andrew LLC, Westchester, IL (US)

( * ) Notice: Subject to any disclaimer, the term of this patent is extended or adjusted under 35 U.S.C. 154(b) by 184 days.

(21) Appl. No.: 11/321,958

(22) Filed: Dec. 29, 2005

(65) Prior Publication Data

US 2006/0273865 A1 Dec. 7, 2006

Related U.S. Application Data

(63) Continuation-in-part of application No. 11/143,377, filed on Jun. 2, 2005, now Pat. No. 7,301,422.

(51) Int. Cl.
*H01Q 9/44* (2006.01)

(52) U.S. Cl. ..... 343/805; 343/795; 343/797; 343/815; 343/819; 343/821

(58) Field of Classification Search ..... 343/795, 343/797, 805, 806, 815, 819, 821
See application file for complete search history.

(56) References Cited

U.S. PATENT DOCUMENTS

| | | | | |
|---|---|---|---|---|
| 4,513,292 | A * | 4/1985 | Bowman | 343/795 |
| 4,860,020 | A | 8/1989 | Wong et al. | |
| 5,245,348 | A | 9/1993 | Nishikawa et al. | |
| 5,274,390 | A | 12/1993 | Breakall | |
| 5,532,707 | A * | 7/1996 | Klinger et al. | 343/793 |
| 5,686,928 | A * | 11/1997 | Pritchett et al. | 343/711 |
| 6,023,245 | A | 2/2000 | Gomez et al. | |
| 6,133,883 | A | 10/2000 | Munson et al. | |
| 6,140,974 | A | 10/2000 | Dalley | |
| 6,333,720 | B1 * | 12/2001 | Gottl et al. | 343/810 |
| 6,496,152 | B2 | 12/2002 | Nilsson | |
| 6,640,085 | B1 | 10/2003 | Chatzipetros et al. | |
| 6,819,291 | B1 | 11/2004 | Lackey et al. | |
| 6,924,776 | B2 | 8/2005 | Le et al. | |
| 2002/0135527 | A1 | 9/2002 | Teillet et al. | |
| 2004/0252070 | A1 * | 12/2004 | Chuang | 343/795 |
| 2004/0263410 | A1 * | 12/2004 | Teillet et al. | 343/797 |
| 2005/0253769 | A1 | 11/2005 | Timofeev et al. | |

FOREIGN PATENT DOCUMENTS

| | | |
|---|---|---|
| EP | 0378 905 A1 | 7/1990 |
| WO | WO 00/54367 | 9/2000 |
| WO | WO 01/11718 A1 | 2/2001 |

* cited by examiner

*Primary Examiner*—Benny T. Lee
(74) *Attorney, Agent, or Firm*—Husch Blackwell Sanders Welsh & Katz

(57) ABSTRACT

An antenna comprising a reflective surface; and an array of dipole antenna elements disposed adjacent to the reflective surface. Each antenna element has a pair of arms which together define a dipole axis, and the dipole axis is tilted at an acute angle with respect to the reflective surface. The pair of arms may be dipole arms, or may be Yagi director arms. In some embodiments the dipole axis is tilted at an acute angle with respect to a feed axis. In some embodiments the antenna element comprises a feed portion defining a feed axis; and the feed portion has a mounting portion which is tilted at an acute angle with respect to the feed axis.

30 Claims, 19 Drawing Sheets

DIPOLE ANTENNA ARRAY HAVING DIPOLE ARMS TILTED AT AN ACUTE ANGLE

CROSS-REFERENCE TO RELATED APPLICATIONS

This is a continuation-in-part of and claims the benefit of priority from application Ser. No. 11/143,377, filed Jun. 2, 2005, entitled "Phase Shifter, A Phase Shifter Assembly, Feed Networks and Antennas," now U.S. Pat. No. 7,301,422.

FIELD OF THE INVENTION

The present invention is related to the field of dipole antennas, and more particularly relates to an antenna with an array of dipole elements, an antenna element for use in such an antenna, and a method of operating such an antenna.

BACKGROUND OF THE INVENTION

Cellular communication systems employ a plurality of antenna systems, each serving a sector or area commonly referred to as a cell. The collective cells make up the total service area for a particular wireless communication network.

Serving each cell is an antenna and associated switches connecting the cell into the overall communication network. Typically, the antenna system is divided into sectors, where each antenna serves a respective sector. For instance, three antennas of an antenna system may serve three sectors, each having a range of coverage of about 120°. These antennas typically have some degree of downtilt such that the beam of the antenna is directed slightly downwardly towards the mobile handsets used by the customers. This desired downtilt is often a function of terrain and other geographical features. However, the optimum value of downtilt is not always predictable prior to actual installation and testing. Thus, there may be a need for custom setting of each antenna's downtilt upon installation of the actual antenna. Typically, high capacity cellular type systems can require re-optimization during a 24 hour period.

U.S. Pat. No. 6,924,776 describes a base station antenna with a plurality of ground planes configured in a staircase arrangement, and an array of dipole antenna elements disposed adjacent to the ground planes. A first problem with the arrangement of U.S. Pat. No. 6,924,776 is that the ground planes are expensive, bulky and heavy. A second problem is that the edges of the steps in the ground plane can cause undesirable diffraction effects.

SUMMARY OF THE INVENTION

The exemplary embodiments of the invention each provide an antenna comprising a reflective surface; and an array of dipole antenna element disposed adjacent to the reflective surface, wherein each antenna element has a pair of arms which together define a dipole axis, and wherein the dipole axis is tilted at an acute angle with respect to the reflective surface.

Certain exemplary embodiments of the invention also provide an antenna element comprising a feed portion defining a feed axis; and a pair of arms which together define a dipole axis, wherein the dipole axis is tilted at an acute angle with respect to the feed axis.

Certain exemplary embodiments of the invention provide an antenna element comprising a feed portion defining a feed axis; and a dipole portion comprising a pair of arms, wherein the feed portion has a mounting portion which is tilted at an acute angle with respect to the feed axis.

BRIEF DESCRIPTION OF THE DRAWINGS

The accompanying drawings which are incorporated in and constitute part of the specification, illustrate embodiments of the invention and, together with the general description of the invention given above, and the detailed description of the embodiments given below, serve to explain the principles of the invention.

DETAILED DESCRIPTION OF THE PREFERRED EMBODIMENTS

Figure 1A:
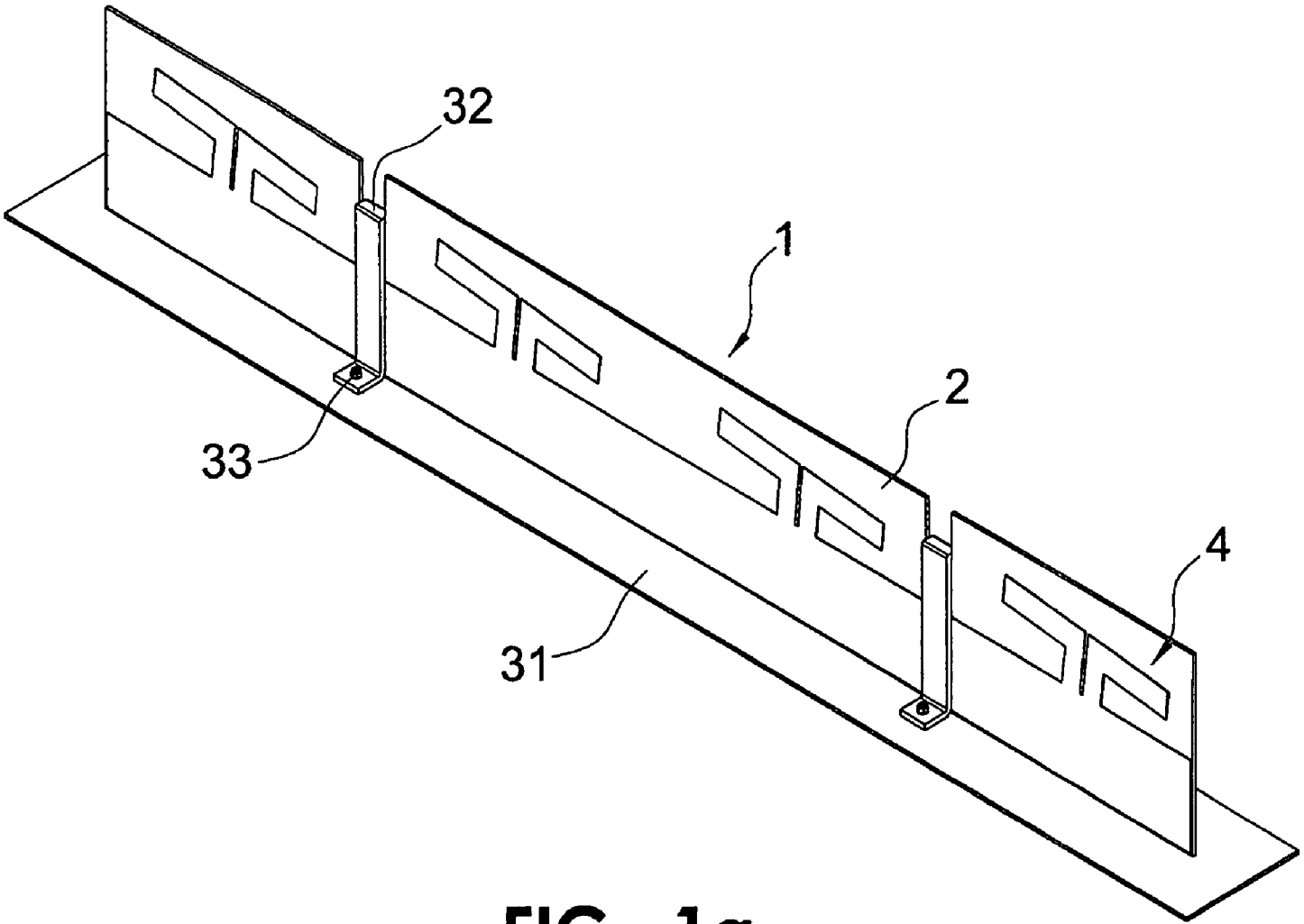
FIG. 1*a* is a perspective view of a vertically polarized antenna.

Referring to FIG. 1*a*, a vertically polarized base station antenna 1 has a reflector 31; and a Printed Circuit Board (PCB) 2 which extends orthogonally from the reflector 31. The PCB 2 is formed with slots which receive plastic supports 32, each support 32 being connected to the reflector 31 by a respective nut and bolt 33.

The PCB 2 is printed with metal layers on both sides. On one side shown in FIG. 1*a* (and shown in solid line in FIG. 1*b*) the PCB carries an array of four dipoles 4 and a continuous metallized area 3. On the other side, the PCB 2 carries a microstrip feed network shown in broken line in FIG. 1*b*. (Herein, like reference numerals refer to the same element, and the descriptions of such elements are not repeated with reference to subsequent figures in which they may appear). The feed network comprises a feed line 5 which is split to feed four hook shaped baluns, each balun interfacing with a respective dipole. The metallized area 3 forms an electrical ground for the microstrip feed network.

Figure 1B:
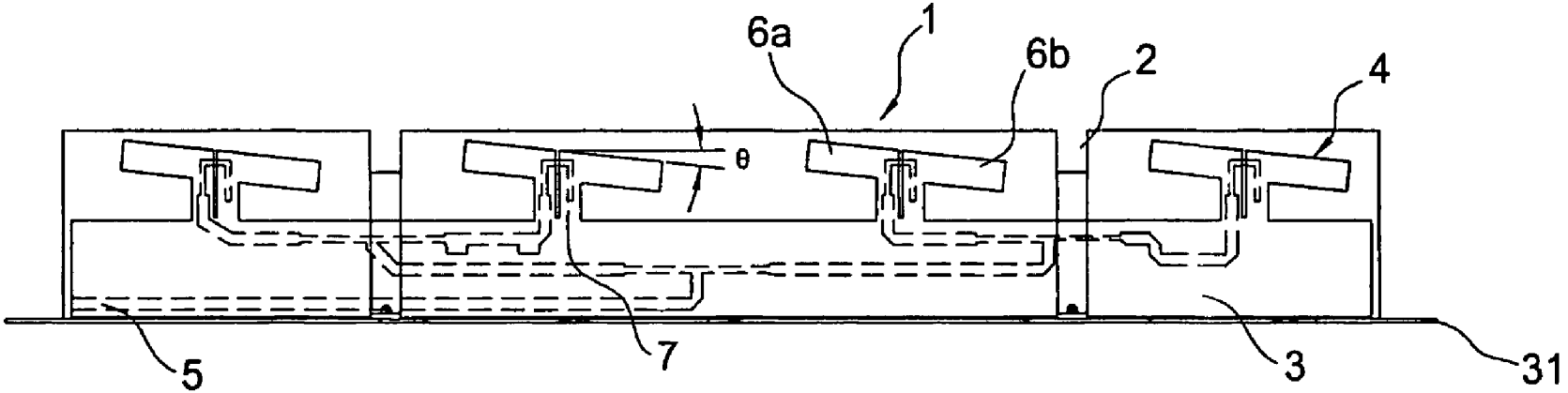
FIG. 1*b* is a side view of the antenna of FIG. 1*a;*

Each dipole has a feed portion comprising a pair of feed legs 7, and a pair of dipole arms 6*a*, 6*b*. The arms 6*a*,6*b* together define a dipole axis which is tilted at an acute angle θ with respect to the reflector 31, as shown in FIG. 1*b*. The feed legs 7 together define a feed axis (running along the length of the gap between the two feed legs) which is substantially orthogonal to the reflector 31, so each dipole axis is also tilted at the acute angle θ with respect to the feed axis.

The reflector 31, being formed from a conductive material and positioned adjacent to the antenna elements, provides a reflective surface which acts as a near-field reflector for the dipoles. Thus when the antenna elements are energized in transmit or receive mode, the reflector 31 reflects radiation to or from the antenna elements to reduce back radiation.

Figure 2:
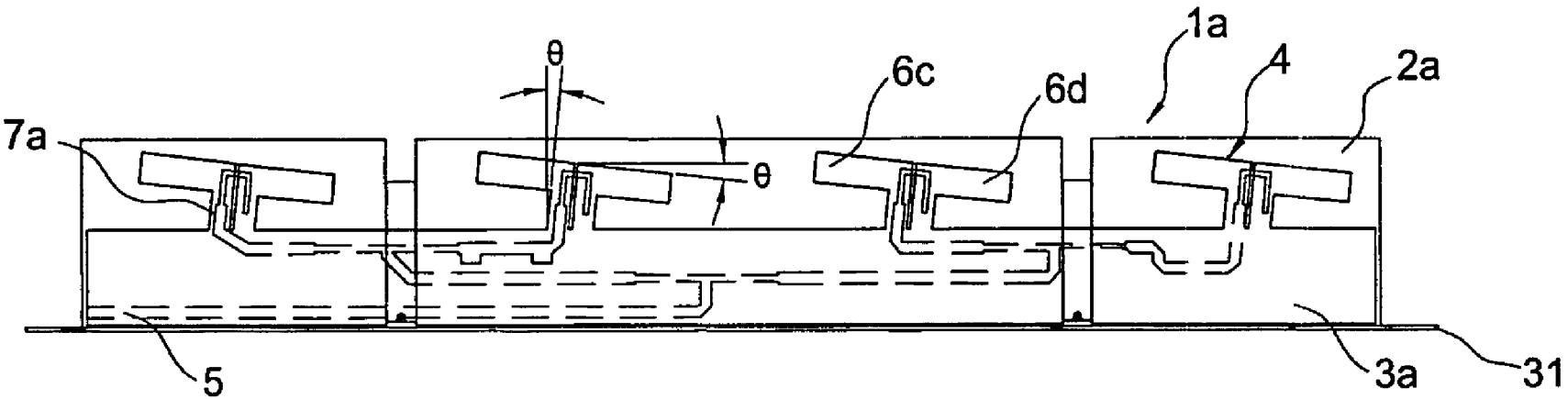
FIG. 2 is a side view of a second vertically polarized antenna.

FIG. 2 is a side view, equivalent to FIG. 1*b*, of a second vertically polarized base station antenna 1*a*. The antenna 1*a* is similar to the antenna 1, and equivalent parts are given the same reference numerals. PCB 2*a* carries an array of four dipoles 4 and a continuous metallized area 3*a*. Each dipole has a pair of feed legs 7*a* and a pair of arms 6*c* 6*d*. As in the antenna 1, the arms 6*c*, 6*d* are tilted at an acute angle θ with respect to the reflector 31. However in contrast to FIG. 1*b*, the feed legs 7*a* are also tilted so that a feed axis defined by the feed legs 7*a* lies at the acute angle θ with respect to the reflector 31, and lies substantially perpendicular to the dipole arms.

The antennae 1 and 1*a* are arranged vertically in use, so they provide a vertically polarized beam. In contrast, the antennae described below with reference to FIGS. 3-12 are dual polarized antennas.

Figure 3A:
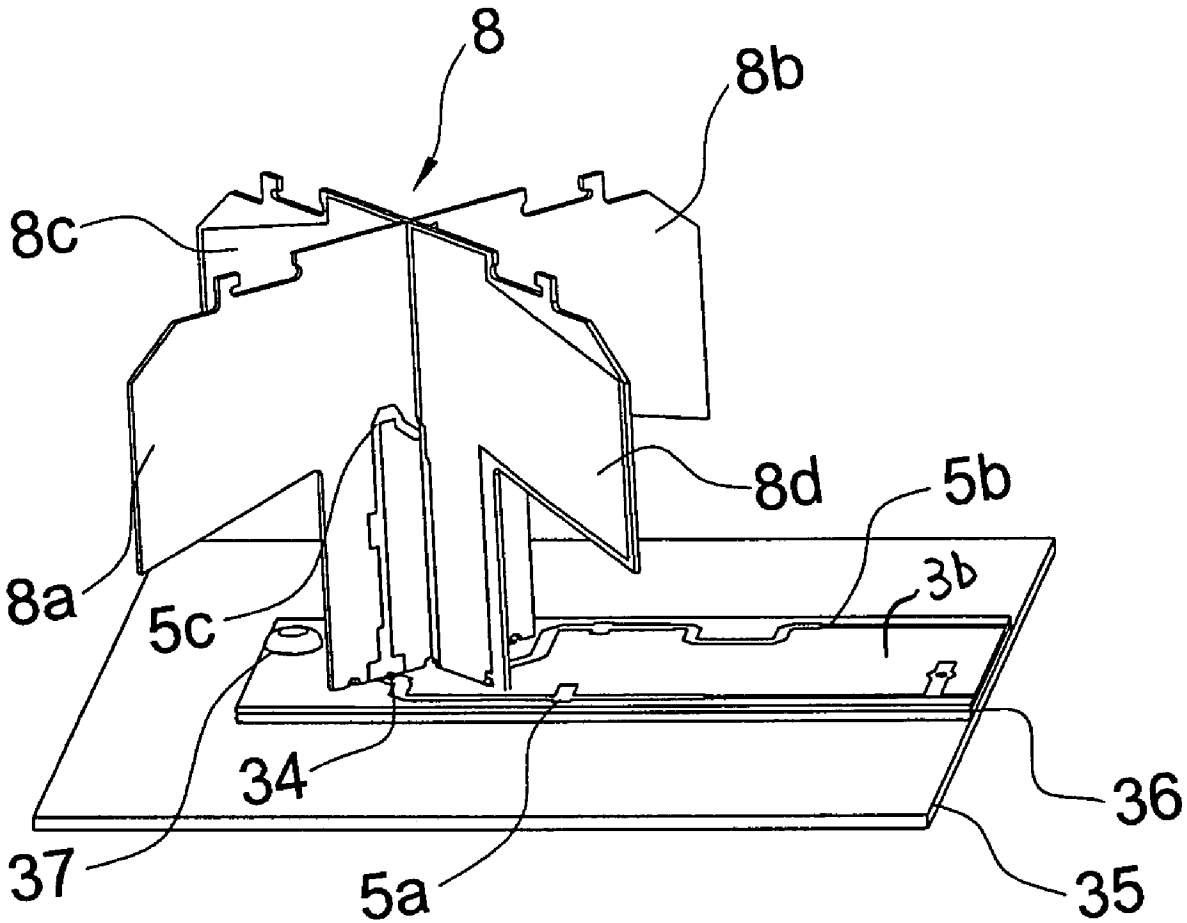
FIG. 3*a* is a perspective view of a dual polarized antenna element.
Figure 3B:
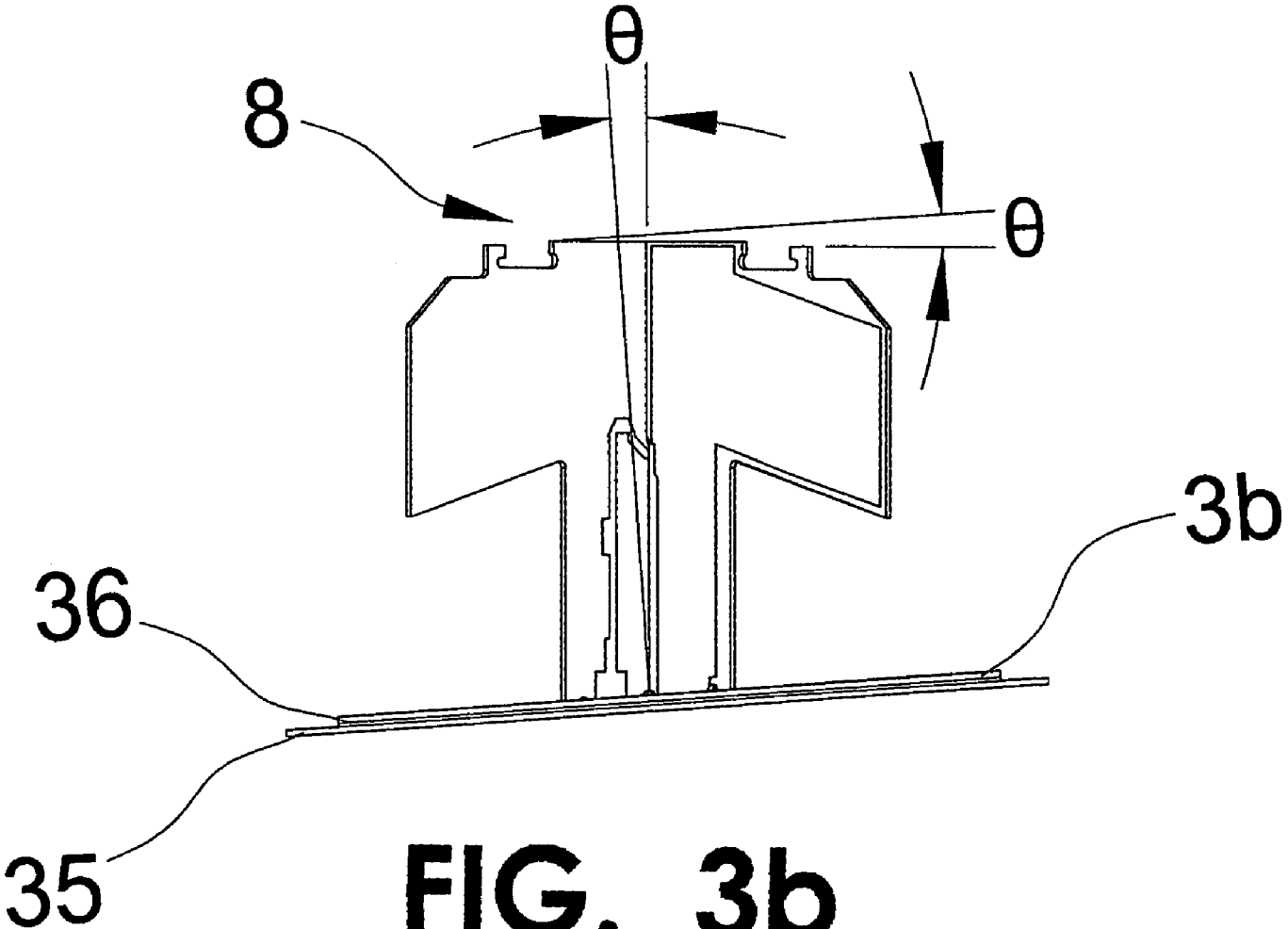
FIG. 3*b* is a side view of the antenna element of FIG. 3*a;*

A first dual polarized antenna element 8 is shown in FIGS. 3*a* and 3*b*. The element comprises two crossed PCBs, each PCB being printed with a dipole on one side and a hook shaped balun on the other (part of one of the baluns being visible in FIG. 3*a* and labeled 5*c*). Each dipole has a feed portion and a dipole portion. The feed portion comprises a pair of dipole feed legs defining a feed axis. The dipole portion comprises a pair of dipole arms defining a dipole axis. In contrast to the vertically polarized antennas shown in FIGS. 1 and 2, the dipole arms droop downwardly so they are not collinear. Thus in this case, the dipole axis can be defined as an imaginary line extending between equivalent points of the two dipole arms, such as their distal ends.

With reference to FIGS. 3*a*, 3*b*, the assembly 8 is mounted on a feed PCB 3*b* which carries a pair of feed lines 5*a*,5*b* on its upper face and a ground plane metallized layer on its lower face (not shown). The feed lines are connected to the baluns by solder connections, the solder connecting feed line 5*a* to balun 5*c* being indicated at 34 (FIG. 3*a*). The feed PCB 3*b* is mounted on a reflector 35 by a layer of double sided tape 36 and a plastic rivet 37.

As shown in FIG. 3*a*, one of the PCBs has a pair of arms 8*a*,8*b* and the other PCB has a pair of arms 8*c*,8*d*. The PCB arms 8*a*-8*d* (and the dipole arms printed on them) droop downwardly towards the reflector 35. The PCBs also have legs (not labeled) with mounting portions at their bottom edges which mount the antenna assembly 8 to the feed PCB 3*b*. The detailed construction of the mounting portions of the PCB legs are described in further detail below with reference to FIG. 8.

The mounting portions of the PCB legs are cut at an angle to the feed axis so that the arms and legs of the PCB (and the dipole arms and legs printed on them) appear tilted at an acute angle θ with respect to the reflector 35, when viewed orthogonally to the antenna axis as shown in FIG. 3*b*. In other words, the whole antenna assembly, including both the dipole feed axis and the dipole axis, is tilted.

Figure 4:
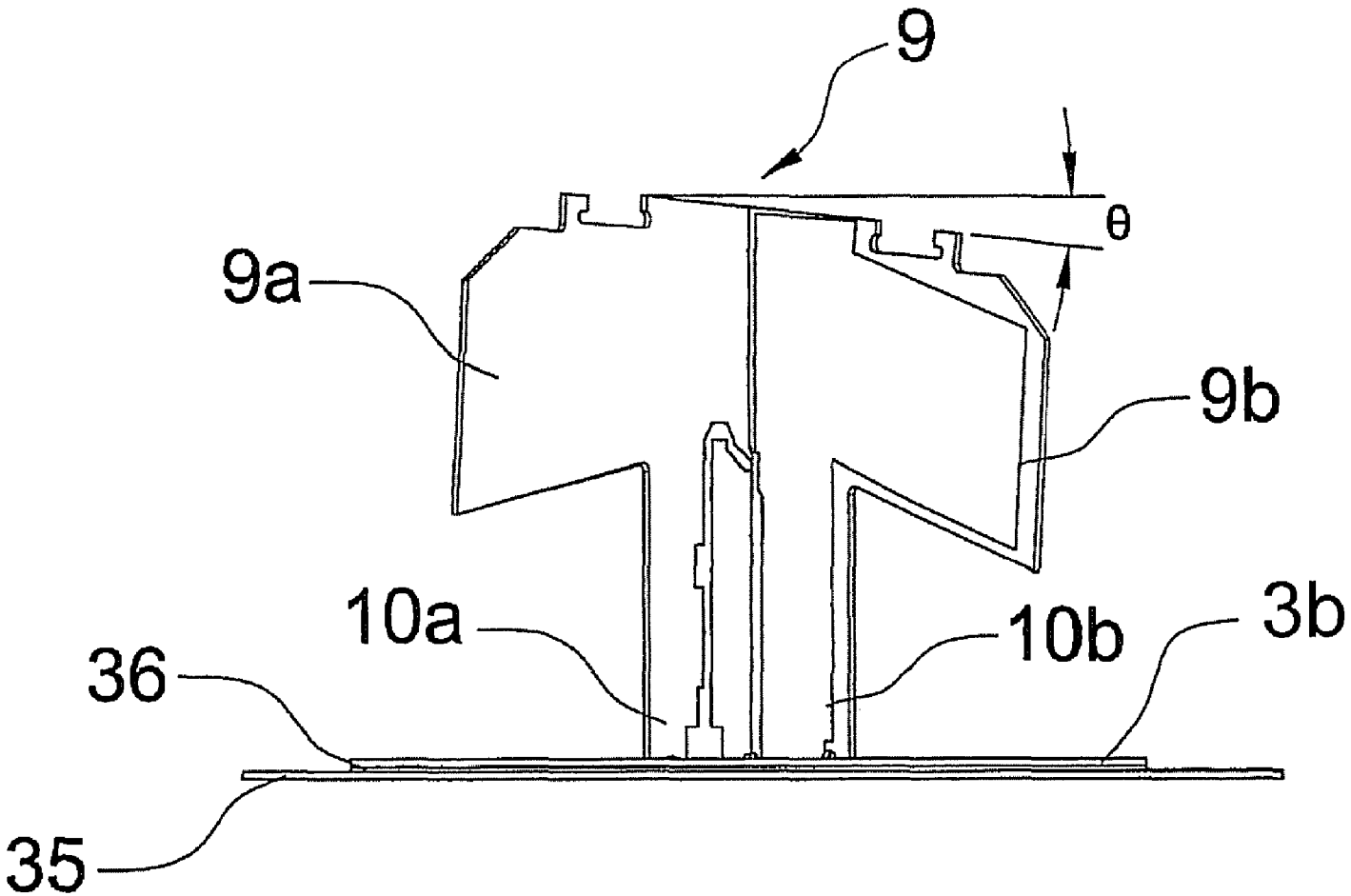
FIG. 4 is a side view of a second dual polarized antenna element.

In the embodiment of FIG. 4, a dipole assembly 9 is shown in which only the dipole axis is tilted. The assembly 9 is identical to the assembly 8 except in this case the bottom edges of the PCB legs 10*a*, 10*b* are cut substantially perpendicular to the feed axis. The PCB legs 10*a*, 10*b* mount the assembly 9 to the feed PCB 3*b*. As a result the feed axis extends at right angles to the reflector 35, instead of being tilted. Instead of cutting the bottom edges of the PCB legs at an angle, the upper and lower edges of the PCB arms 9*a*, 9*b* are cut so that the PCB arms 9*a*, 9*b* appear tilted at an acute angle θ with respect to the reflector 35 when viewed from the side as in FIG. 4. The printed arms of the dipoles are centered in the PCB arms 9*a*, 9*b* so that they are also tilted at an acute angle to the reflector 35.

Figure 5A:
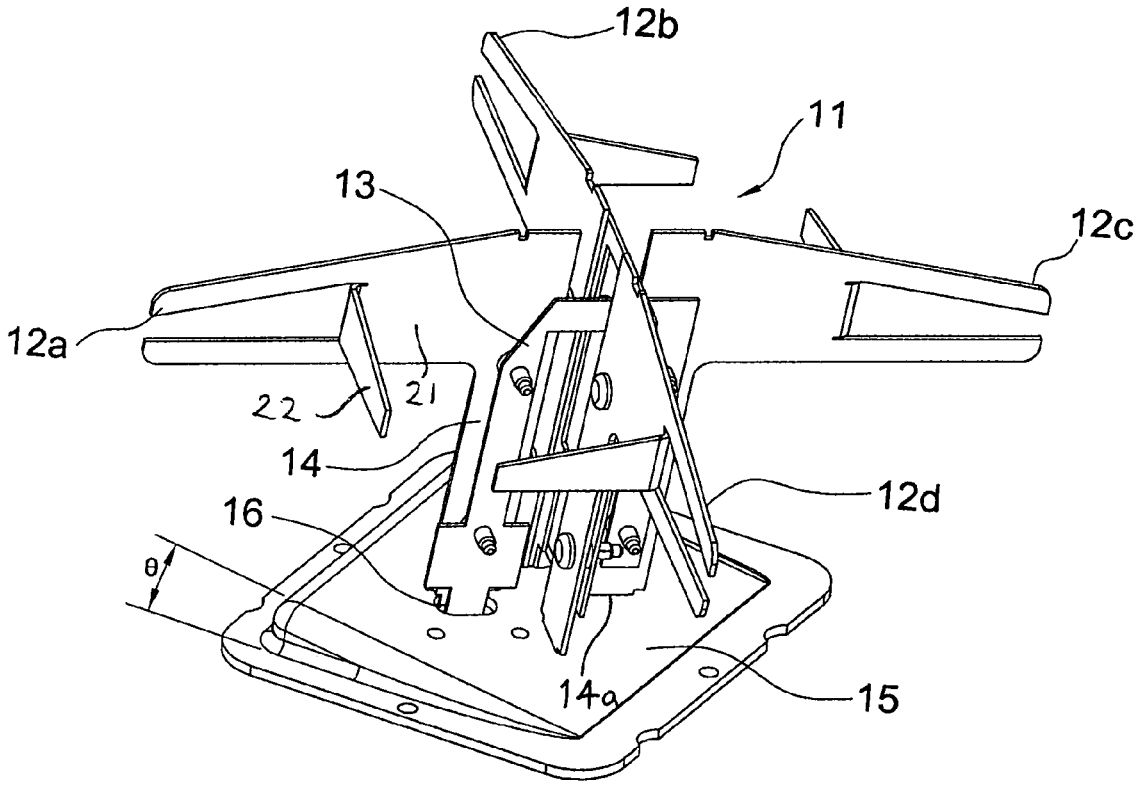
FIG. 5*a* is a perspective view of a third dual polarized antenna element.
Figure 5B:
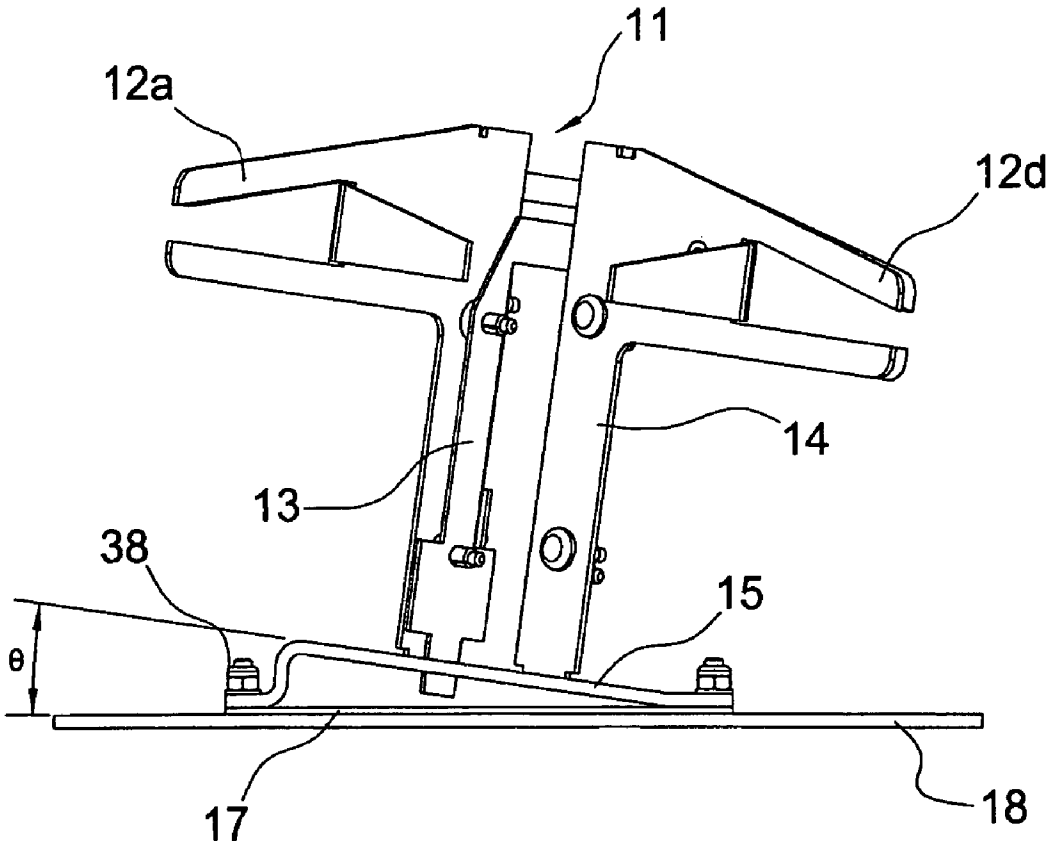
FIG. 5*b* is a side view of part of a third dual polarized antenna incorporating the element of FIG. 5*a;*

FIGS. 5*a* and 5*b* show a third dual polarized antenna element assembly 11. The assembly is similar to one of the assemblies shown in U.S. Patent Application Publication 2005/0253769, the disclosure of which is incorporated herein by reference. Referring first to FIG. 5*a*, a +45 degree dipole and a −45 degree dipole are each formed from conductive material (typically stamped aluminum) which is cut and folded into the form shown.

Each dipole has a pair of legs 14 and a pair of dipole arms. With continued reference to FIGS. 5*a* and 5*b*, the arms of the +45 degree dipole are labeled 12*a*,12*c*, and the arms of the −45 degree dipole are labeled 12*b*,12*d*. Each arm has a first portion extending from a central axis and a second portion extending out of a plane including the first portion and the central axis. Thus, as shown in FIG. 5*a*, by way of example, the dipole arm 12*a* has a first portion 21 extending from a central axis, and a second portion 22 extending out of a plane including the first portion and the central axis. The second portions of the arms 12*a*,12*c* of the +45 degree dipole extend in a first rotational direction (anticlockwise) and the second portions of the arms 12*b*,12*d* of the −45 degree dipole extend in a second rotational direction (clockwise). As described in U.S. Patent Application Publication 2005/0253769, this enables a reduced dipole height relative to the reflector.

Figure 6:
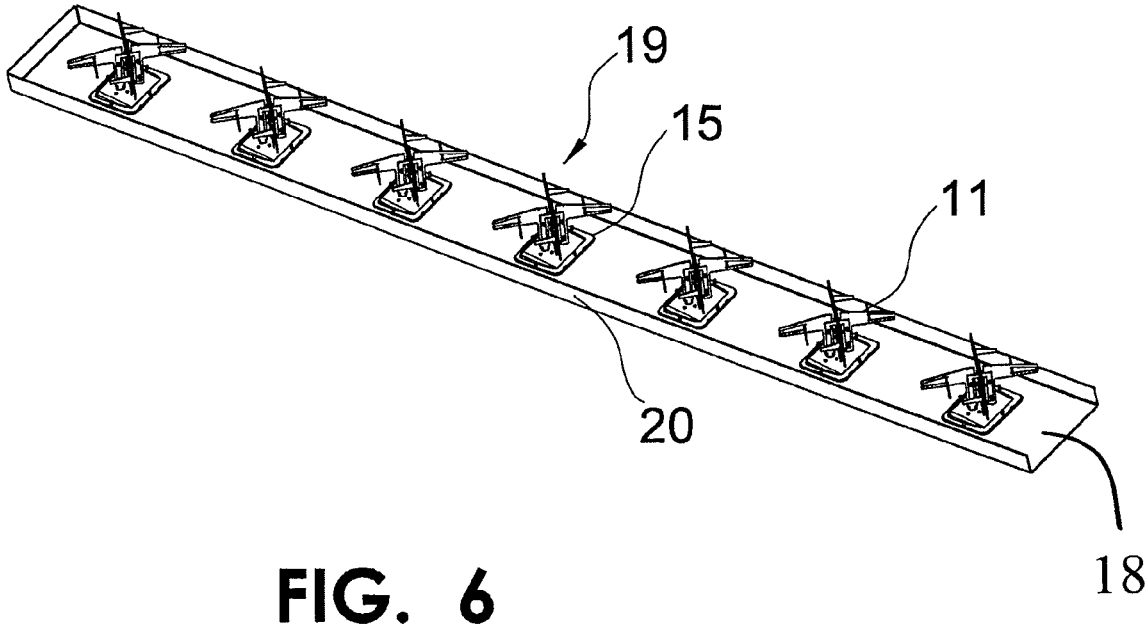
FIG. 6 is a perspective view of the third dual polarized antenna.

A wideband dual polarized base station antenna 19 incorporating the element 11 of FIGS. 5*a* and 5*b* is shown in FIG. 6. The antenna has a tray 20; and an array of five crossed dipole assemblies 11 arranged in a straight line along the antenna axis.

The antenna assemblies 11 are configured in a staircase arrangement, but in contrast with U.S. Pat. No. 6,924,776, the reflector comprises the base 18 of the tray 20: that is, a continuous structure of conductive material, typically a single sheet of aluminum or brass alloy which is folded at its sides to form a pair of side walls. This results in a more simplified structure compared with the staircase reflector structure of U.S. Pat. No. 6,924,776, reducing manufacturing costs. It also reduces the bulk and weight of the reflector structure, compared with the staircase reflector structure of U.S. Pat. No. 6,924,776.

Each antenna assembly 11 has a mounting portion in the form of a respective pedestal, an exemplary one of the pedestals being shown in FIGS. 5*a* and 5*b*. The pedestal has an antenna support surface 15 which is tilted at the tilt angle θ with respect to the reflector 18 (FIG. 5*b*), and a flange extending from the support surface, the flange being substantially parallel with the reflector 18. The pedestal is mounted to the tray by four nuts and bolts passing through holes in the flange. One of the nut and bolt assemblies is indicated at 38 in FIG. 5*b*. A dielectric gasket 17 is positioned between the pedestal and the tray to minimize intermodulation.

Each dipole leg 14 has a tab 14*a* (FIG. 5*a*) extending from its distal end which is received in a slot (not shown) in the antenna support surface 15. A pair of shoulders on the side of the tab engage the upper face of the support surface 15 to ensure that the dipole legs are orientated at right angles to the surface 15. The tabs 14*a* are fixed to the support surface by welding. In an alternative embodiment (not shown) the pedestal and dipole element may be formed together as a single piece by casting.

The support surface 15 is involved in element beam pattern forming, and so the width of the surface 15 is optimized to achieve a minimal level in the upper grating lobe zone (discussed in further detail below with reference to FIG. 6*b*). In this case the width of the pedestal support surface 15 is approximately half the width of the pair of dipole arms.

The dipole is driven by an airstrip hook shaped balun 13 which is mounted to the dipole legs 14 by four insulating spacers. The leg of the balun 13 extends through a hole 16 (FIG. 5*a*) in the pedestal and is soldered to the inner conductor of a coaxial cable (not shown). The outer conductor of the coaxial cable is soldered to the pedestal. The inner conductor of the coaxial cable (not shown) passes through a hole (not shown) in the gasket 17 and the tray 18 and is soldered at its other end to a PCB-mounted feed network on the rear side of the tray. The feed network includes phase shifters shown in FIG. 6*a* which can be adjusted by an adjustment rod 23 to vary the relative phase between the dipole assemblies and hence vary the down tilt of the antenna beam. In this example the phase shifters are of the type described in further detail in U.S. Pat. No. 6,717,555, the disclosure of which is incorporated herein by reference. Alternatively, the phase shifters may be of the type shown in U.S. Patent Application Publication 2005/0253769, the disclosure of which is incorporated herein by reference. In general, any one of a large variety of phase shifter constructions may be used.

FIG. 6 shows an array configured for operation at 806-960 MHz. The tilt angle θ is 8 degrees and the phase shifters can increase the beam downtilt up to a maximum of 17 degrees. In an alternative embodiment (not shown) the array may be configured for operation at 1710-2180 MHz, the tilt angle θ may be 4 degrees, and the beam downtilt can be increased to a maximum of 17 degrees.

The performance of the antenna of FIG. 6 will now be discussed with reference to FIG. 6*b*. FIG. 6*b* shows a radiation pattern 40 in the vertical plane for a single antenna element 11 at 960 MHz. As discussed in detail below, FIG. 6*b* shows that the pattern 40 has a suppressed upper grating lobe.

Grating lobes cause gain loss and pattern distortions, and present a serious problem in base station antenna design. Traditional methods for grating lobe (GL) suppression (element spacing reduction and narrowing of the element pattern) usually do not work for a base station antenna (BSA) because: a) the dual polarized elements are usually large; b) port-to port isolation suffers with spacing reduction; and c) the BSAs are wideband (25-30%), and for higher frequencies, GLs can still occur. Using antenna elements with a narrow pattern is also not acceptable because BSAs require a wide pattern (90° is standard).

The position $\in_1$ of a GL can be found from equation (1) (Practical Phased Array Antenna Systems, ch. 2-4, Dr. Eli Brookner, Artech House, 1991, ISBN: 1580531245):

$$\sin \in_1 = \sin \in_0 - \lambda/d \qquad \text{equation (1)}$$

where d is the element spacing, and $\in_0$ is the beam tilt angle set by the phase shifters (i.e. $\in_0$ is zero in the absence of phase shift).

The radiation pattern F(∈) of the BSA can be obtained by multiplying the element pattern f(∈) by an array factor $F_A$(∈):

$$F(\in) = f(\in) F_A(\in),$$

$F_A(\in_1)=1$ for a GL, so the GL level in direction $\in_1$ is approximately equal to the element pattern level in this direction $f(\in_1)$.

Figure 6A:
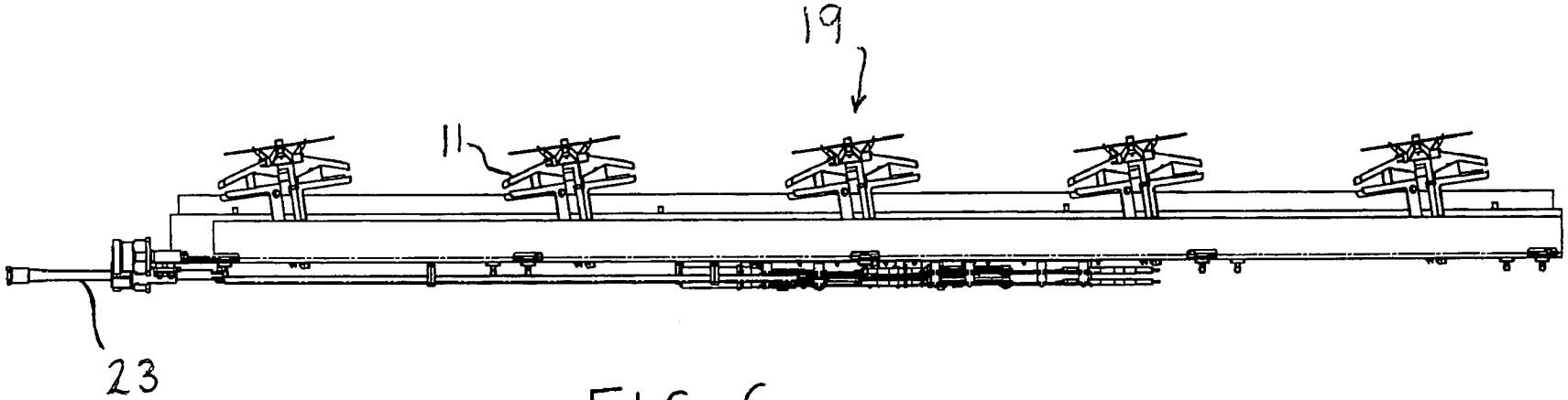
FIG. 6*a* is a side view of the third dual polarized antenna.
Figure 6B:
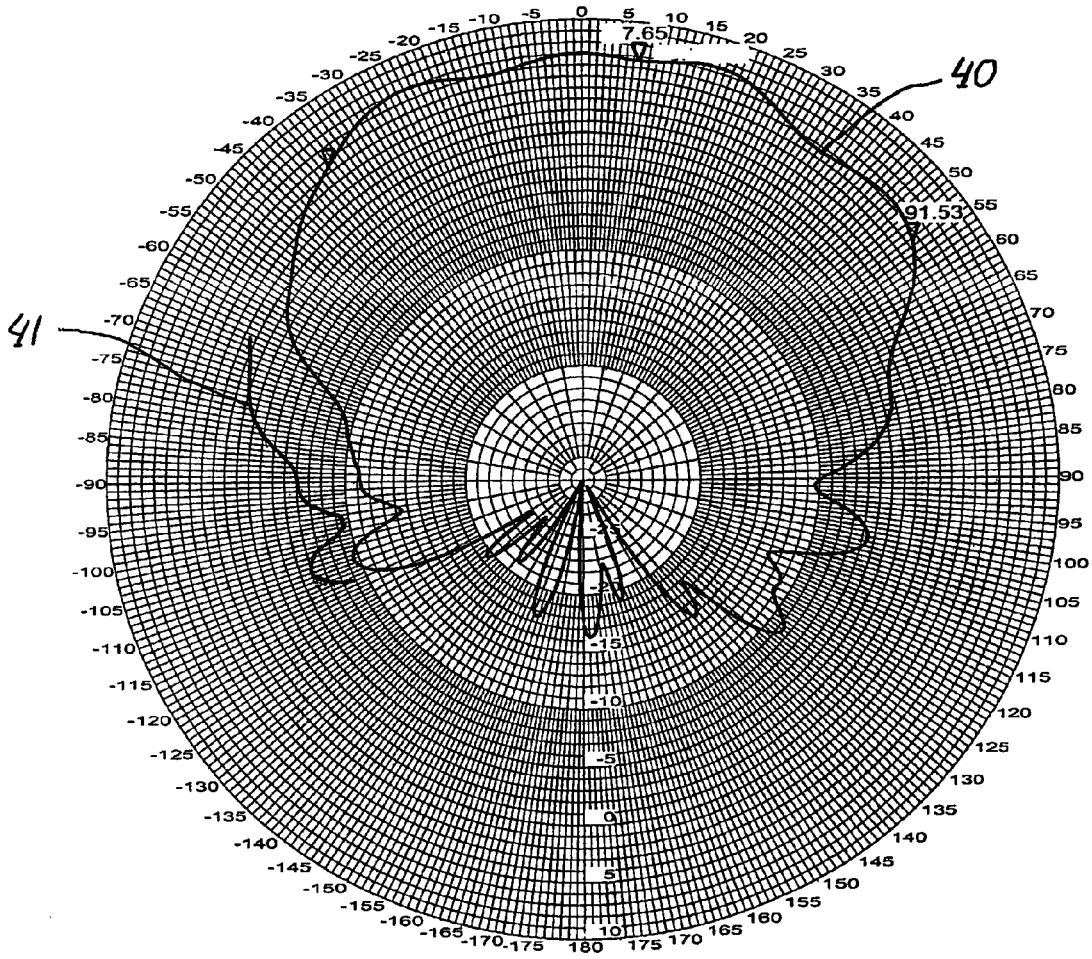
FIG. 6*b* shows a pair of radiation patterns in the vertical plane.

In FIG. 6*b*, a pattern 40 is shown for the central antenna element in the antenna of FIG. 6, at a frequency 960 MHz, an element spacing d of 10 inches, and an angle of tilt of 8°. FIG. 6*b* also shows part of the beam pattern 41 of a non-tilted element. As shown, the pattern 40 is tilted down by an angle of approximately 7.65 deg. In accordance with equation (1), the upper grating lobe position (for a beam tilt $\in_0$=17°) is −70 to −82° for a frequency range of 920-960 MHz. As one can see from FIG. 6*b*, in this angle zone, pattern 40 has 6-8 dB less level then pattern 41. This shows that the tilting of the element suppresses the upper grating lobe by 5 to 8 dB, reducing it from −7.5~−11 dB to −14~−17 dB. This improves the antenna gain for large angles of downtilt, because less energy goes to the grating lobe. By variation of the size and tilt angle of pedestal support surface 15, the element pattern 40 can be optimized for better grating lobe suppression.

It has also been found that the element tilt significantly improves port-to-port isolation, because coupling between neighboring elements is reduced. This enables the antenna to meet the industry standard of 30 dB without requiring parasitic elements. Measurements have shown 6 dB less coupling between neighboring array elements in the case of 8 deg. tilted dipoles, in comparison with straight dipoles. One reason for this is that the opposing tips of the dipole arms of adjacent elements are more far from each other.

The antenna incorporates a radome (not shown) in use. It has been found that the radome has less effect on return loss (VSWR) of the antenna array in the case of a tilted dipole element, because power reflected from the radome does not go straight back to the element. Also, it has been found that the horizontal beam squint of the pattern is improved in comparison to an equivalent antenna without tilted dipoles.

In the embodiment of FIG. 6, each dipole assembly 11 is mounted on a pedestal. The pedestal is formed in the shape of a wedge at the desired tilt angle θ, and as a result the feed legs and dipole arms are both tilted at the acute tilt angle θ. More specifically, referring to FIG. 5*a*, each dipole element has a pair of dipole feed legs 14 defining a feed axis and a pair of dipole arms 12*a*,12*c* defining a dipole axis (which can be defined, for example, as an imaginary line extending between equivalent points of the two dipole arms, such as the distal ends of parts 22). In this case both the feed axis and the dipole axis are tilted.

Figure 7:
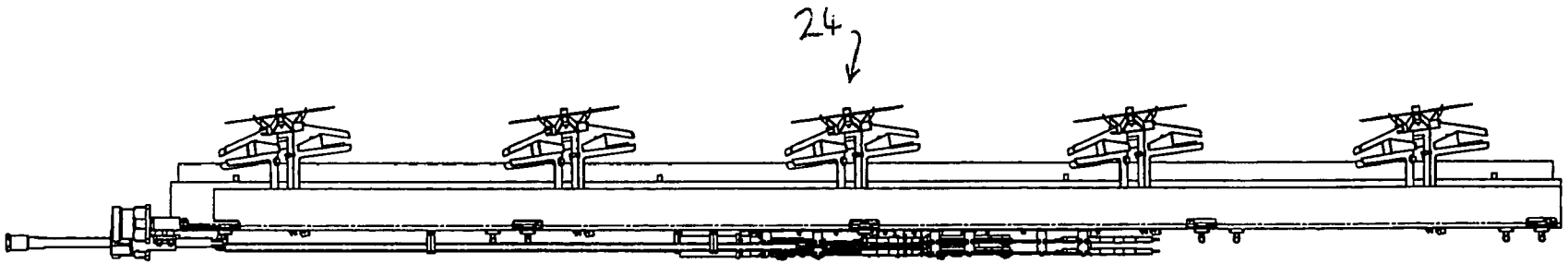
FIG. 7 is a side view of a fourth dual polarized antenna.

By contrast, in the embodiment of FIG. 7 only the dipole axis of each element 24 is tilted. In the case of FIG. 7, no angled pedestals are required and the dipole assemblies can be constructed and mounted in a similar manner to the elements shown in U.S. Patent Application Publication 2005/0253769. Specifically, the element 24 is formed from a single piece in contrast to the element shown in FIG. 5*a* in which the element is formed from four separate pieces which are separately welded to the pedestal. The dipole legs of the element 24 extend from a base (not shown) which is welded to the tray, or attached by a nut and bolt. The base lies parallel to the reflector. The required angle of tilt for the antenna elements 24 shown in FIG. 7 is achieved by cutting out the dipole arms at an angle so that the dipole axis is at an angle to the feed axis.

The antenna of FIG. 7 is easier to construct than the antenna of FIG. 6*a*, but the antenna of FIG. 6*a* performs a little better than the antenna of FIG. 7 in some cases.

Figure 8:
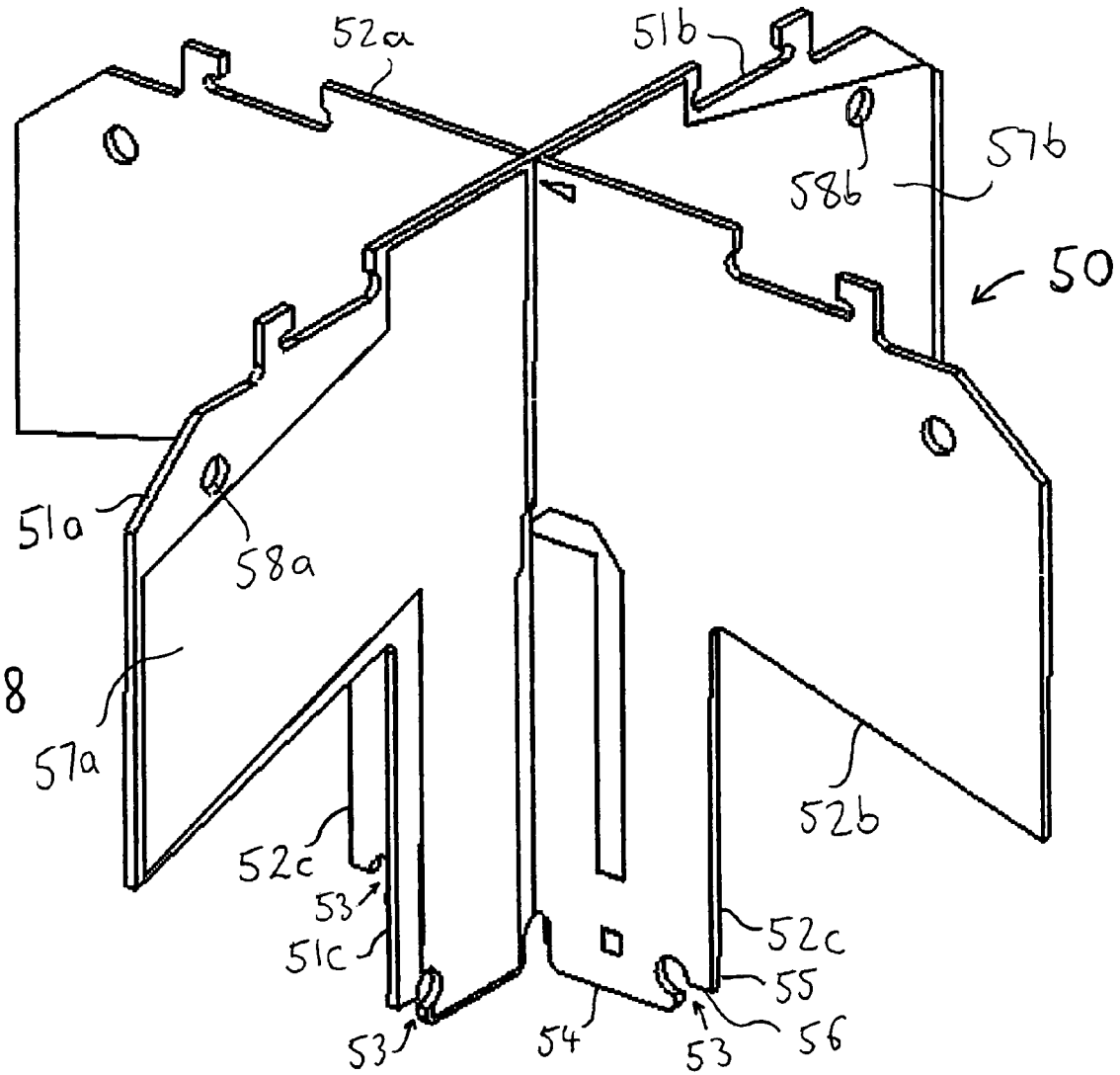
FIG. 8 is a perspective view of a fifth dual polarized antenna element.

In the embodiment of FIG. 8, a dipole assembly 50 is shown. The assembly 50 is similar to the assembly 8 shown in FIGS. 3*a* and 3*b*, and the assembly 9 shown in FIG. 4. FIG. 8 also shows the mounting portions of the PCB legs, which are not visible in FIG. 3*a*,3*b* or 4. A first T-shaped PCB has arms 51*a*,51*b* and a leg 51*c*. The leg 51*c* has a slot running along its length which receives the second PCB. A second T-shaped PCB has arms 52*a*,52*b* and a leg 52*c*. A slot is formed between the arms 52*a*,52*b* to receive the first PCB, but in contrast with the leg 51*c* of first PCB the leg 52*c* has no slot running along its length.

Each leg 51*c*,52*c* is cut at its two bottom corners with "keyhole" shaped slots 53 to form a hook 54 and a tab 55. The feed PCB on which the assembly is mounted has four slots, each of which receives a respective one of the hooks 54. The tabs 55 have bottom edges 56 which engage the top surface of the feed PCB and provide physical support for the antenna assembly.

In the assembly 8 shown in FIGS. 3*a* and 3*b* the mounting portions of the PCB legs (in particular the bottom edges 56 of the tabs 55) are cut at an acute angle to the feed axis to provide the desired tilt. In contrast, in the assembly 9 shown in FIG. 4, and the assembly 50 shown in FIG. 8, the mounting portions of the PCB legs are cut at right angles so that the feed axis is substantially perpendicular to the reflector (instead of being tilted). In the assembly 9 shown in FIG. 4, the PCB arms are cut at the desired angle of tilt, with the dipole arms centered on the PCB arms. In contrast, in the assembly 50 shown in FIG. 8 the PCB arms 51*a*,51*b*,52*a*,52*b* are not tilted, and the required angle of tilt is achieved by forming the metal layers off-center on the PCB arms at the desired angle. This can be appreciated from FIG. 8 by comparing the relative positions of dipole arms 57*a*,57*b* and holes 58*a*,58*b*. The hole 58*a* is above the arm 57*a*, while the hole 58*b* is within the arm 57*b*. This makes it clear that the dipole arm 57*a* is tilted down relative to the dipole arm 57*b*.

Figure 9:
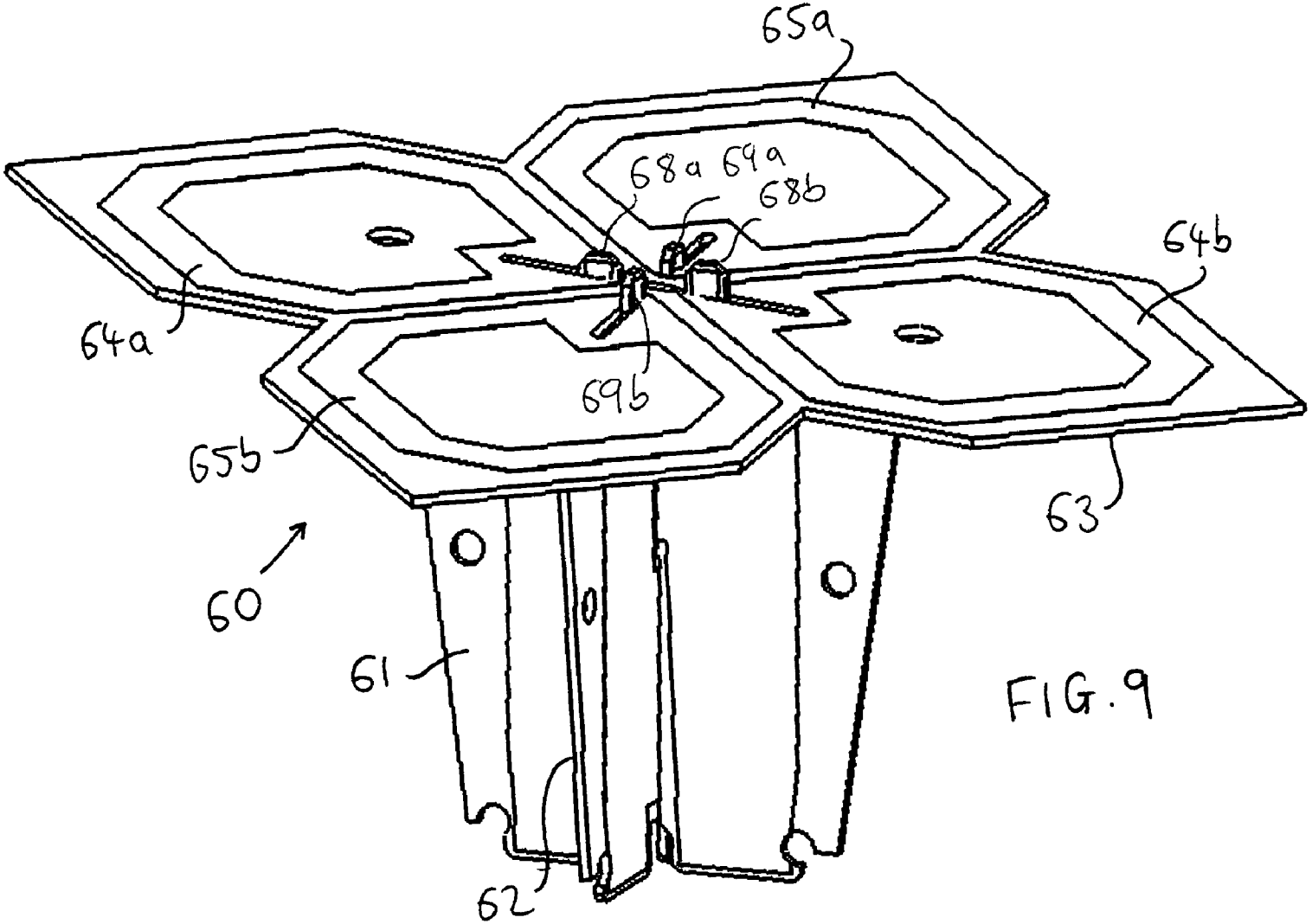
FIG. 9 is a perspective view of a sixth dual polarized antenna element.

In the embodiment of FIG. 9, a further dipole antenna assembly 60 is shown. The assembly has a feed portion (PCBs 61,62) and a dipole leg portion (PCB 63). The feed portion comprises two crossed PCBs 61,62 which carry feed lines terminating in tabs 68*a*,68*b* and 69*a*,69*b* respectively. The feed portion has a lower mounting portion (the bottom edges of the PCBs 61,62) for mounting the assembly to the antenna tray, and an upper mounting portion (the top edges of the PCBs 61,62) which engages the PCB 63.

Figure 10:
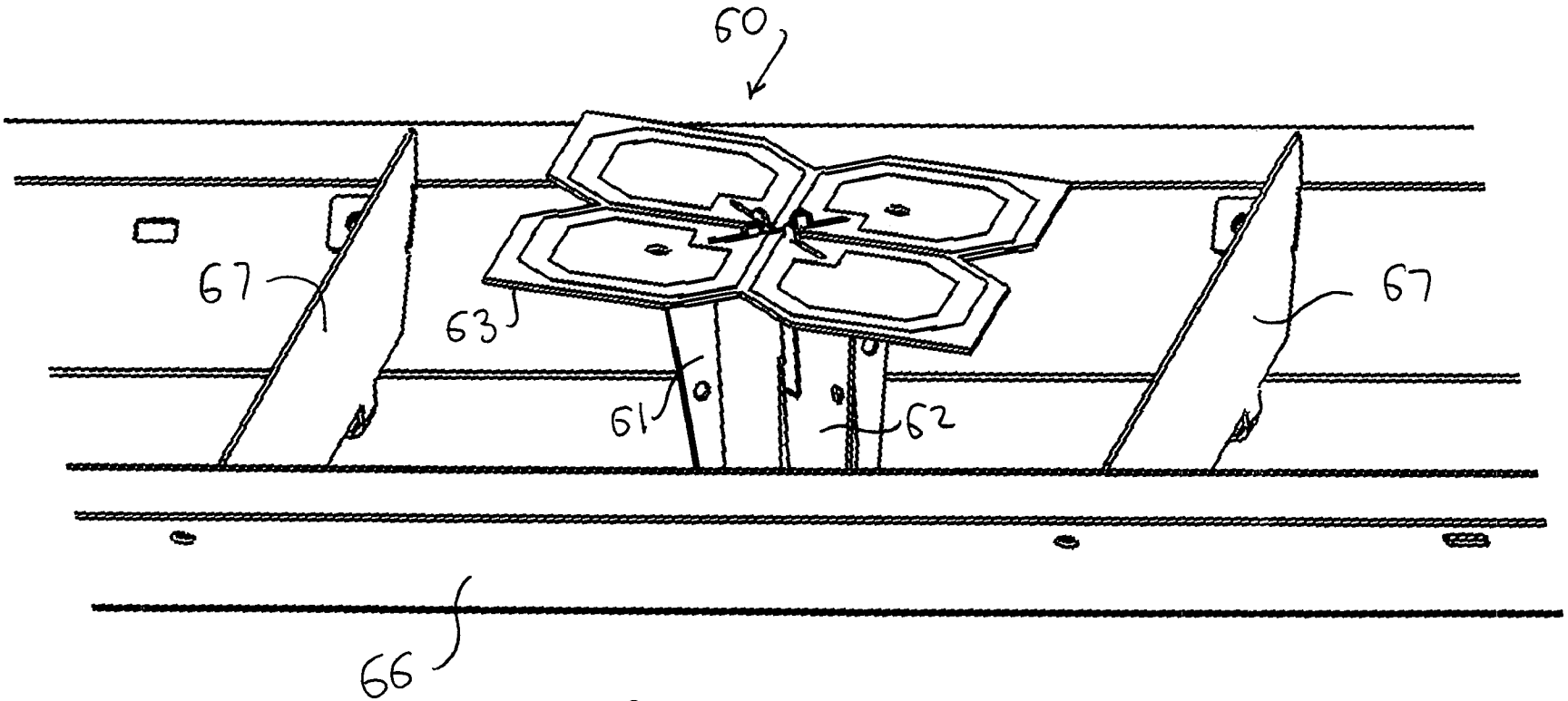
FIG. 10 is a perspective view of part of a dual polarized antenna incorporating the element of FIG. 9.

The bottom edges of the PCBs 61,62 are cut at right angles so that, when mounted on a tray as shown in FIG. 10, the feed axis extends at right angles to the tray. The dipole portion (PCB 63) is mounted on the upper edges of the PCBs 61,62. The PCB 63 carries a pair of crossed dipoles on its upper surface comprising dipole arms 64*a*,64*b* and 65*a*,65*b*, which are soldered to tabs 68*a*,68*b* and 69*a*,69*b* respectively.

The assembly 60 is mounted in use in a tray 66 as shown in FIG. 10, separated from adjacent dipole assemblies (not shown) by fences 67. The upper edges of the PCBs 61,62 are cut at the desired angle of tilt so that the PCB 63 is tilted in the direction of the antenna axis as shown in FIG. 10.

Figure 11:
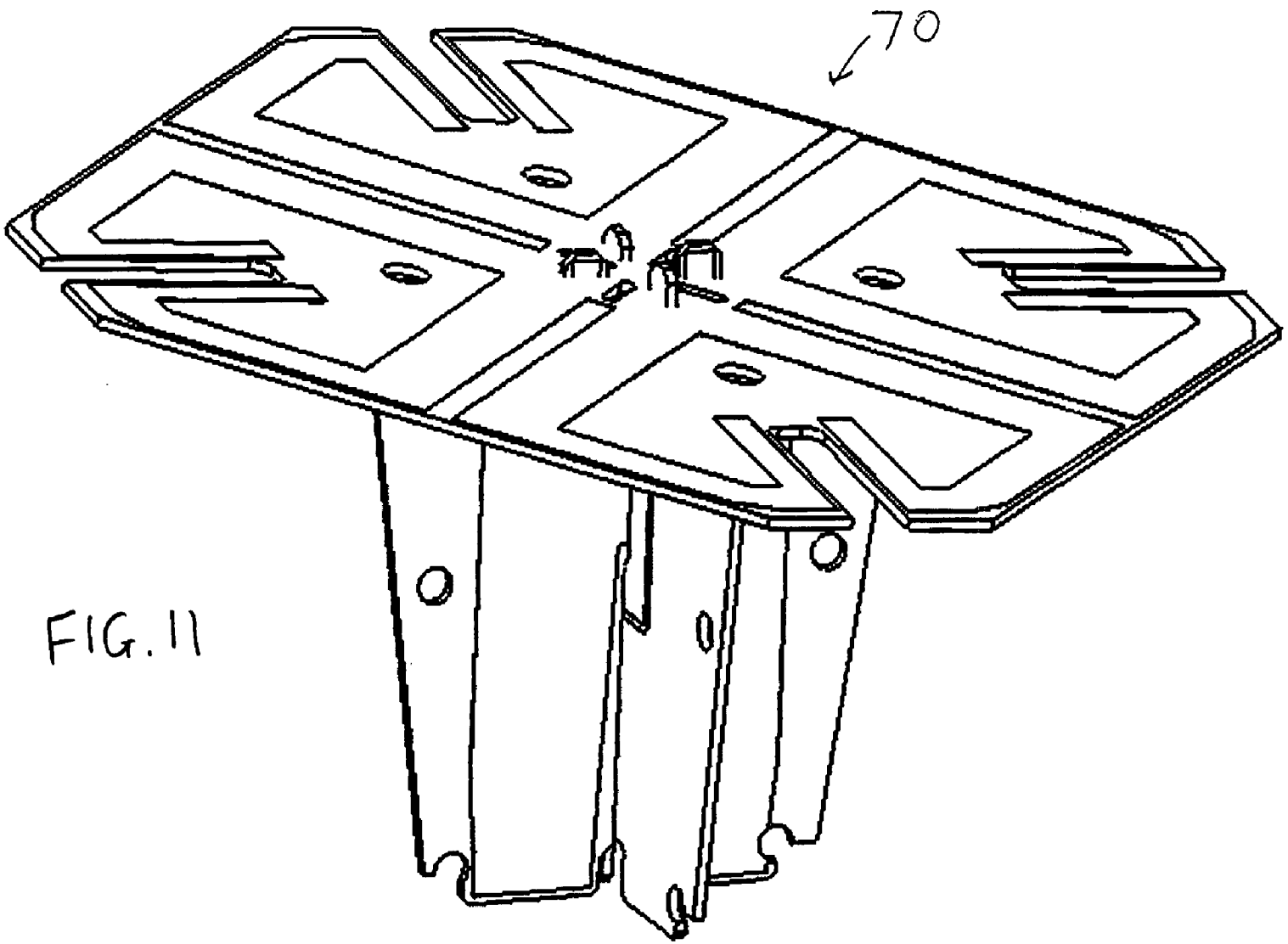
FIG. 11 is a perspective view of a seventh dual polarized antenna element.
Figure 12:
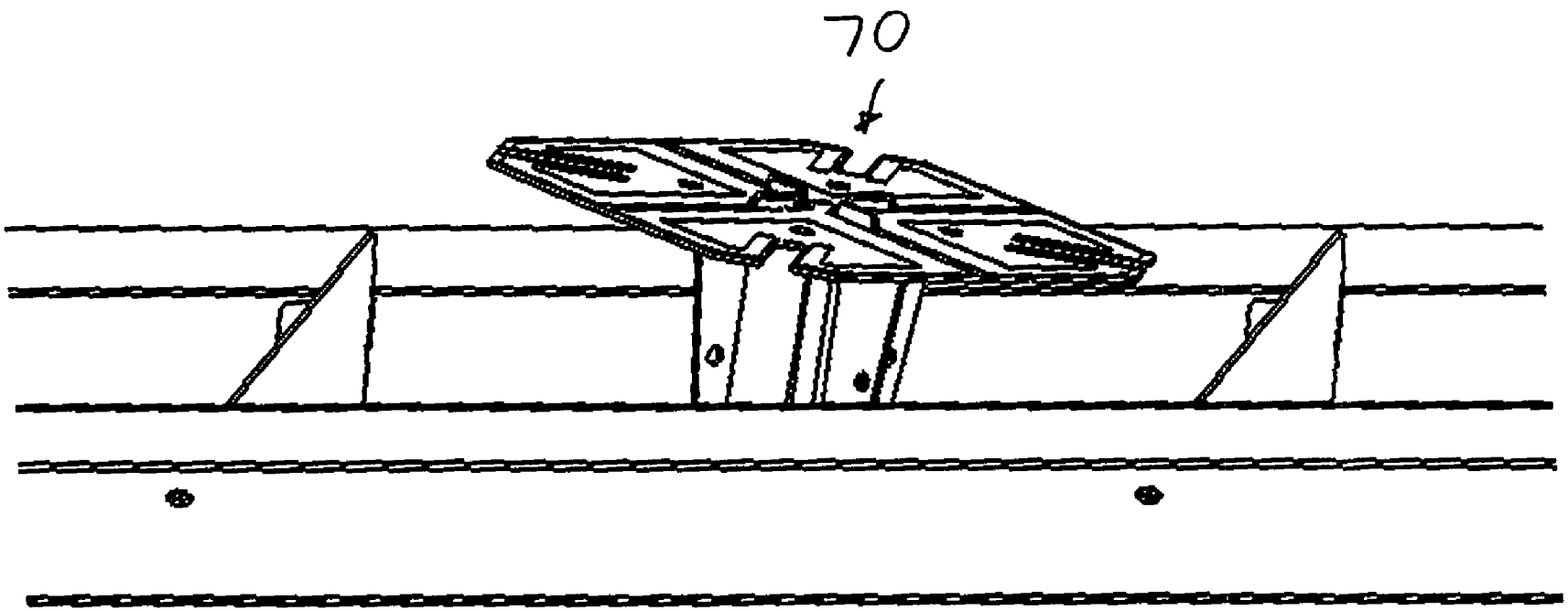
FIG. 12 is a perspective view of part of a dual polarized antenna incorporating the element of FIG. 11.

In the embodiment of FIGS. 11 and 12, a further dipole assembly 70 is shown. The assembly is similar to assembly 60, but in this case the dipole arms have a slightly different form.

Figure 13:
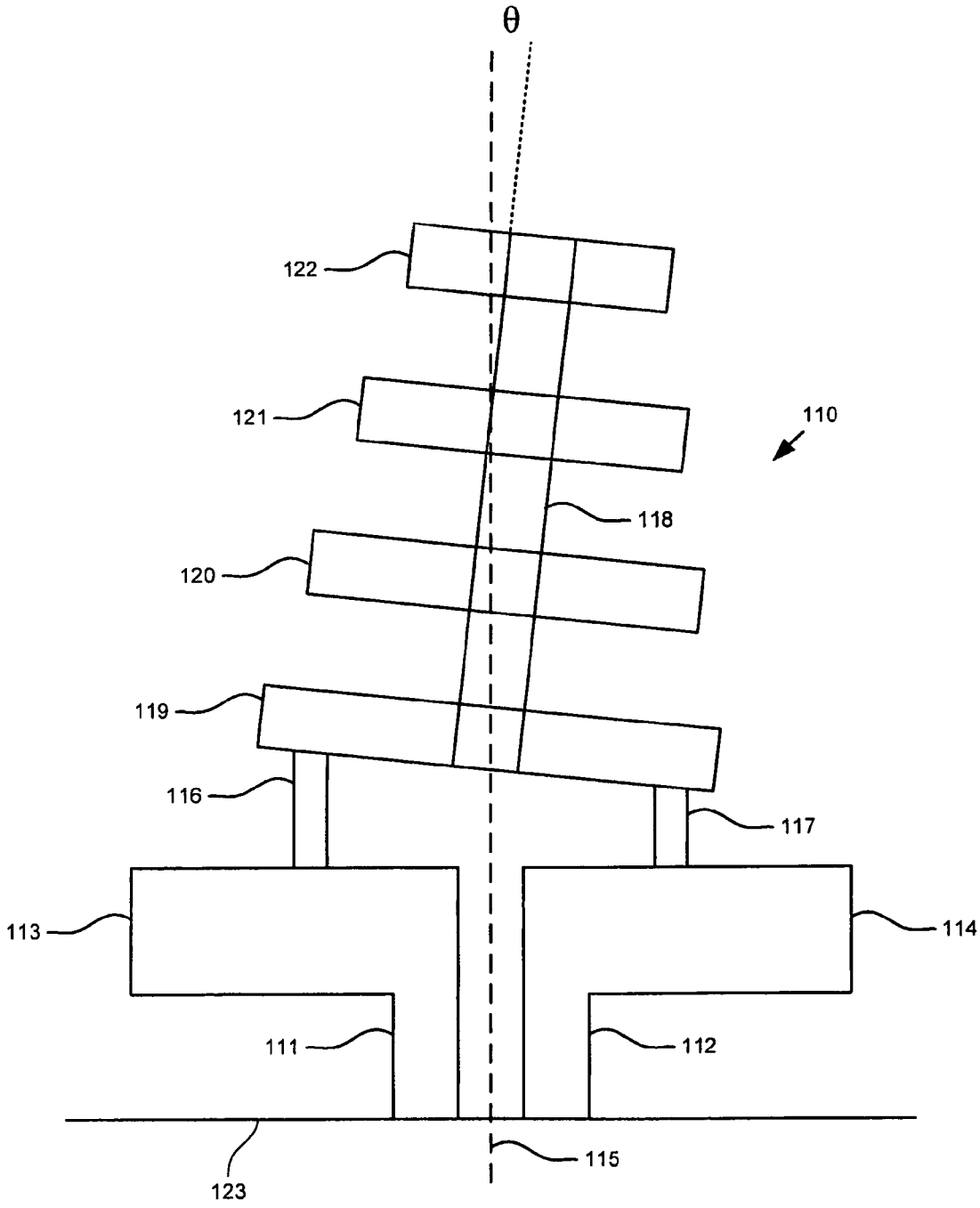
FIG. 13 is a side view of a vertically polarized Yagi dipole antenna element.

In a further embodiment, a Yagi dipole element 110 shown in FIG. 13 is used as the antenna element of the array. The element comprises a feed portion and a director portion. The feed portion comprises a pair of dipole legs 111,112 and a driven element comprising a pair of directly driven dipole arms 113,114. The dipole legs together define a feed axis 115 at right angles to an antenna reflector 123. The director portion comprises four pairs of Yagi director arms 119, 120, 121, and 122 mounted on a boom 118. The director portion is mounted to the feed portion by a pair of supports 116,117. The director arms are parasitically driven by the driven element. The boom 118 is tilted so that a dipole axis defined by the director arms is tilted at the desired angle θ to the feed axis 115.

In a further embodiment (not shown) the boom may be collinear with the feed axis and the director arms may be tilted with respect to the boom.

In a further embodiment (not shown) the driven element and/or the entire Yagi dipole antenna element 110 may be tilted with respect to the reflector.

The Yagi dipole element 110 shown in FIG. 13 is vertically polarized, but an equivalent dual polarized version may also be provided.

Figure 14:
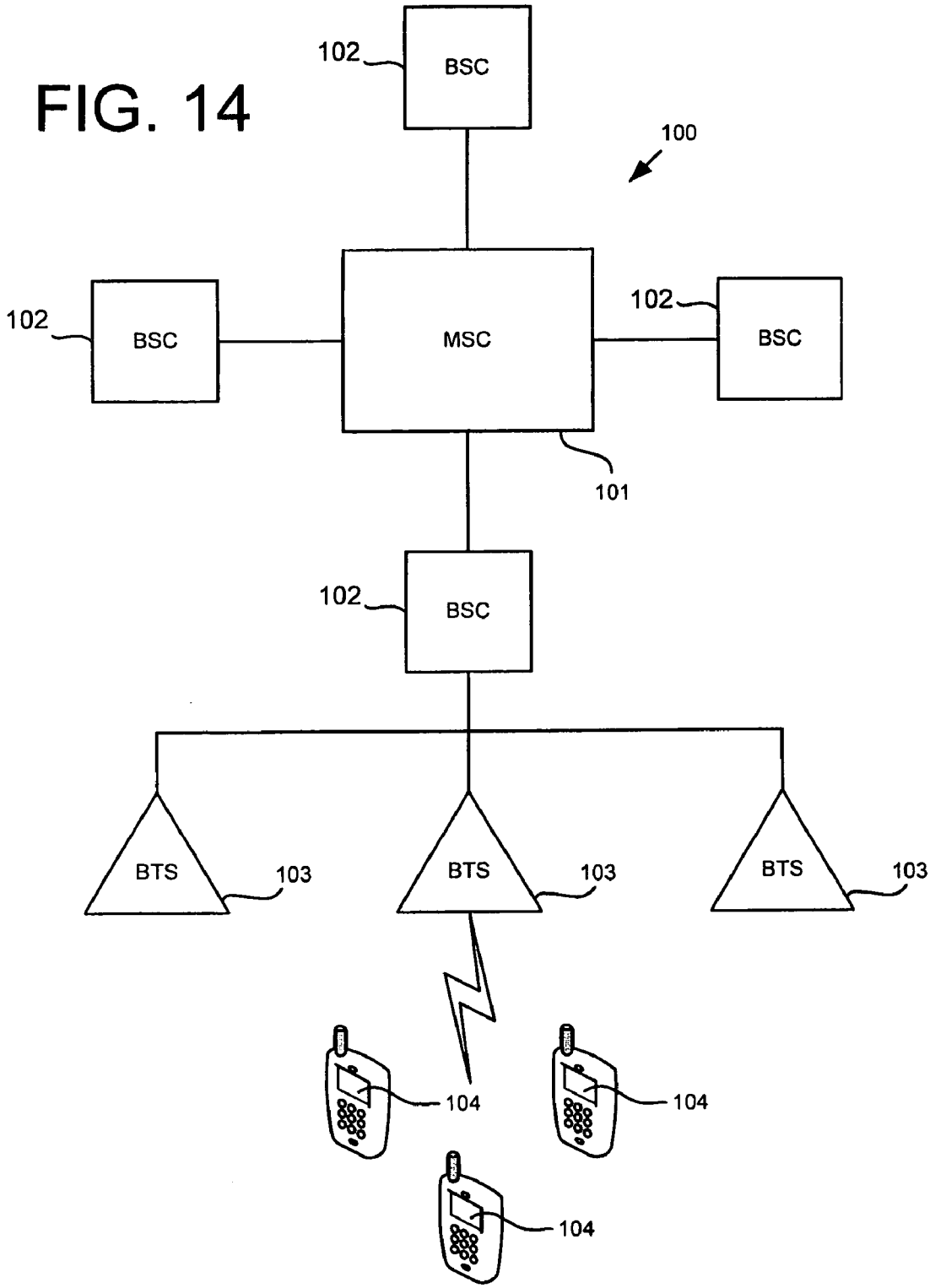
FIG. 14 shows a wireless cellular communication system.

The antennas described above are designed to be incorporated into a wireless cellular communication system 100 of the type shown in FIG. 14. A Mobile Switching Centre (MSC) 101 interfaces with a network of Base Station Controllers (BSCs) 102. Each BSC interfaces with a number of Base Transceiver Stations (BTSs) 103. Each BTS 103 has three base station antennae, each of which interfaces with Mobile Stations (MSs) 104 in a respective cell having a range of coverage of about 120°.

In the antennas described above, the dipole assemblies are arranged in a single line (that is, as a one-dimensional linear array) but in other embodiments (not shown) the units may be arranged in a two dimensional array.

In the antennas described above, the electrical ground for the microstrip feed network, and the primary near-field reflector for the dipoles, are formed by separate elements. In an other embodiments (not shown) a single element may perform both functions.

In the antennas described above, the reflective surface is provided by a single continuous substantially planar sheet of conductive material, but in alternative embodiments (not shown) the reflective surface may be provided by a number of separate elements, by a grid with holes smaller than $1/8^{th}$ of the wavelength, or by a non-planar element.

Although useful in wireless base stations, the present invention can also be used in all types of telecommunications systems.

Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

What is claimed is:

1. An antenna comprising a reflective surface; and an array of dipole antenna elements disposed adjacent to the reflective surface, wherein each antenna element has a feed portion defining a feed axis and a pair of arms which together define a dipole axis, and wherein the dipole axis is tilted at an acute angle with respect to the reflective surface.

2. The antenna of claim 1 further comprising a feed network coupled to the array of antenna elements and adapted to selectively adjust a beam tilt of the antenna.

3. The antenna of claim 2 wherein the feed network includes one or more phase shifters adapted to selectively adjust a phase relationship between the antenna elements.

4. The antenna of claim 1 wherein the reflective surface comprises a continuous surface.

5. The antenna of claim 1 wherein the reflective surface is a single piece of material.

6. The antenna of claim 1 wherein the reflective surface is substantially planar.

7. The antenna of claim 1 wherein the reflective surface comprises a base of a tray, the tray further comprising a pair of side walls.

8. The antenna of claim 7 wherein the base and side walls of the tray is a single piece of conductive material.

9. The antenna of claim 1 wherein the dipole axis is tilted at an acute angle with respect to the feed axis.

10. The antenna of claim 1 wherein the feed axis is tilted at an acute angle with respect to the reflective surface.

11. The antenna of claim 1 wherein the feed portion includes a pedestal with a support surface which is tilted with respect to the reflective surface.

12. The antenna of claim 11 wherein the pedestal has a flange extending from the support surface, the flange being substantially parallel with the reflective surface.

13. The antenna of claim 1 wherein the pair of arms of each antenna element are disposed on a substrate, and the substrate is tilted at an acute angle with respect to the reflective surface.

14. The antenna of claim 1 wherein each antenna element comprises a dual polarized antenna element.

15. The antenna of claim 14 wherein the pair of arms of each dual polarized antenna element comprise first pair of dipole arms, wherein each dual polarized antenna element further comprises a second pair of arms comprising second pair of dipole arms, and wherein the feed axes corresponding to the first and second airs of arms define a central axis, each arm of the first and second pairs of arms having a first portion extending from the central axis of the dual polarized antenna element and a second portion extending out of a plane including the first portion and the central axis.

16. The antenna of claim 1 wherein the pair of arms of each antenna element are dipole arms.

17. The antenna of claim 1 wherein the pair of arms of each antenna element are Yagi director arms.

18. A base station comprising the antenna of claim 1.

19. A wireless communication system comprising a plurality of base stations according to claim 18, each antenna configured to communicate with a plurality of mobile devices in a respective cell.

20. A dipole antenna element comprising a feed portion defining a feed axis; and a pair of arms which together define a dipole axis, wherein the dipole axis is tilted at an acute angle with respect to the feed axis.

21. The antenna element of claim 20 wherein the pair of arms are disposed on a substrate, and the substrate is tilted at an acute angle with respect to the feed axis.

22. The antenna element of claim 20 wherein the pair of arms comprises a pair of Yagi director arms.

23. The antenna element of claim 22 wherein the feed portion comprises a pair of directly driven dipole aims, and the Yagi director arms are parasitically driven by the directly driven dipole arms.

24. The antenna element of claim 20 wherein the pair of arms comprise a pair of dipole arms.

25. A dipole antenna element comprising a feed portion defining a feed axis; and a dipole portion comprising a pair of arms, wherein the feed portion has a mounting portion which is tilted at an acute angle with respect to the feed axis.

26. The antenna element of claim 25 wherein the pair of arms together define a dipole axis, and wherein the mounting portion is tilted at an acute angle with respect to the dipole axis.

27. The antenna element of claim 25 wherein the feed portion comprises a substrate carrying a feed leg, and the mounting portion comprises an edge of the substrate.

28. The antenna element of claim 25 wherein the mounting portion comprises a flange.

29. The antenna element of claim 25 wherein the mounting portion engages the dipole portion.

30. A method of operating an antenna comprising an array of dipole antenna elements, each antenna element having a feed portion defining a feed axis and a pair of arms which together define a dipole axis, the method comprising energizing the antenna elements so as to transmit or receive radiation, and reflecting radiation to or from the antenna elements with a reflector disposed adjacent to the antenna elements which is tilted at an acute angle with respect to each dipole axis.

* * * * *